US006714212B1

(12) United States Patent
Tsuboyama et al.

(10) Patent No.: US 6,714,212 B1
(45) Date of Patent: Mar. 30, 2004

(54) DISPLAY APPARATUS

(75) Inventors: Akira Tsuboyama, Atsugi (JP); Takeshi Makita, Kawasaki (JP); Kazunori Katakura, Atsugi (JP); Kazumi Suga, Tokyo (JP); Manabu Iwasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/974,551

(22) Filed: Nov. 19, 1997

Related U.S. Application Data

(63) Continuation of application No. 08/318,299, filed on Oct. 5, 1994, now abandoned.

(30) Foreign Application Priority Data

Oct. 5, 1993 (JP) ..... 5-271215

(51) Int. Cl.[7] ..... G09G 5/02
(52) U.S. Cl. ..... 345/696; 345/695
(58) Field of Search ..... 345/87, 694, 695, 345/696, 88, 89

(56) References Cited

U.S. PATENT DOCUMENTS

| | | | | |
|---|---|---|---|---|
| 4,712,877 A | | 12/1987 | Okada et al. | 350/350 S |
| 4,763,994 A | | 8/1988 | Kaneko et al. | 350/336 |
| 4,791,417 A | * | 12/1988 | Bobak | 345/149 |
| 4,824,218 A | | 4/1989 | Kuno et al. | 350/350 S |
| 5,124,695 A | | 6/1992 | Green | 340/784 |
| 5,259,042 A | * | 11/1993 | Matsuki et al. | 382/50 |
| 5,404,236 A | * | 4/1995 | Hartmann et al. | 345/149 |
| 5,412,395 A | * | 5/1995 | Maeda et al. | 345/149 |
| 5,499,037 A | * | 3/1996 | Nakagawa et al. | 345/87 |

FOREIGN PATENT DOCUMENTS

| | | |
|---|---|---|
| EP | 0219479 | 4/1987 |
| JP | 5546783 | 4/1980 |
| JP | 6142591 | 3/1986 |
| JP | 1267519 | 10/1989 |

* cited by examiner

*Primary Examiner*—Kent Chang
(74) *Attorney, Agent, or Firm*—Fitzpatrick, Cella, Harper & Scinto

(57) ABSTRACT

A display apparatus has a plurality unit pixels each divided into a least three sub-pixels for displaying a halftone. The at least three sub-pixels have mutually different areas, so that one sub-pixel among the at least three sub-pixels has a maximum area which does not exceed a total area of the remaining sub-pixels. As a result, it is possible to obviate a so-called linear defect occurring in a multi-level gradational display by suppressing the shift of gravity center of light spots and change in sub-pixel arrangement pattern in displaying slightly different gradation levels.

28 Claims, 7 Drawing Sheets

DISPLAY APPARATUS

This is a continuation application, under 37 CFR 1.62 of prior application Ser. No. 08/318,299, filed on Oct. 5, 1994, currently entitled DISPLAY APPARATUS, now abandoned.

FIELD OF THE INVENTION AND RELATED ART

The present invention relates to a display apparatus used in various image data processing apparatus, such as monitors for computer terminals and word processors, and view finders for video cameras.

In display apparatus including those based on plasma display, liquid crystal device, electrochromic device, it is desired to effect multi-level gradational display in order to display high-quality images.

In case of dividing one pixel into a plurality of sub-pixels each capable of binary display, it has been known to form sub-pixels having areal ratios of $2^0:2^1:2^2:2^3: \ldots$. By such division, it is possible to effect $2^N$ levels of gradational display by constituting one pixel with N sub-pixels. Such a gradational display method has been disclosed in Japanese Laid-Open Patent Application (JP-A) 1-267519, JP-A 55-46783, EP-A 0219479, Japanese Laid-Open Utility Model Application 61-42591, and U.S. Pat. No. 5,124,695.

On the other hand, a gradational display method utilizing a partial areal inversion in a unit pixel based on an applied electric field and not utilizing areal or spatial division of a unit pixel into sub-pixels as described above, has been disclosed in, e.g., U.S. Pat. Nos. 4,712,877, 4,763,994 and 4,824,218.

The former gradational display method of using sub-pixels can be effected by a simpler drive circuit than the latter gradational display method and is therefor economically advantageous.

FIG. 1 is a schematic view of a pixel including sub-pixels. As shown in FIG. 1, one pixel is divided into three color pixels of R, G and B by vertical boundary lines, and each color pixel (unit pixel) is divided into four sub-pixels having areal ratios of 1:2:4:8 so as to obtain a required number of gradation levels ($2^4$=16 in this case). Accordingly, in this case, each color is displayed in 16 levels, and 4096 colors can be displayed in one pixel. This type of division pattern wherein one pixel is divided into three colors of R, G, and B by vertical boundary lines and further divided by horizontal lines, is hereinafter called division pattern A.

However, such a division scheme can cause a problem regarding image quality in some cases. More specifically, in displaying images having continuously changing gradation levels such as photographic images and computer graphic images by using a display device having such a pixel arrangement, an experiment of image processing by the dither method was performed in order to display a more natural image. As a result, an unintended characteristic pattern (linear defect) appeared at a part of changing certain gradation levels. Such a pattern can deteriorate the image quality.

SUMMARY OF THE INVENTION

In view of the above-mentioned problem, an object of the present invention is to provide a display apparatus wherein the occurrence of such a "linear defect" found to be attributable to a pixel division pattern for a multi-level gradational display is suppressed by a simple re-arrangement According to the present invention, there is provided a display apparatus comprising a plurality of unit pixels each divided into a least three sub-pixels for displaying a halftone, said at least three sub-pixels having mutually different areas; wherein one sub-pixels among said at least three sub-pixel has a maximum area which does not exceed a total area of the remaining sub-pixels among said at least three sub-pixels.

According to the above arrangement of sub-pixels in a unit pixel, it is possible to suppress a change in gravity center of photo-spots in a pixel and a change in pixel pattern accompanying a display of different halftone or gradation levels. As a result, the linear defect attributable to a pixel division pattern can be suppressed and a continuous gradational display can be smoothly performed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
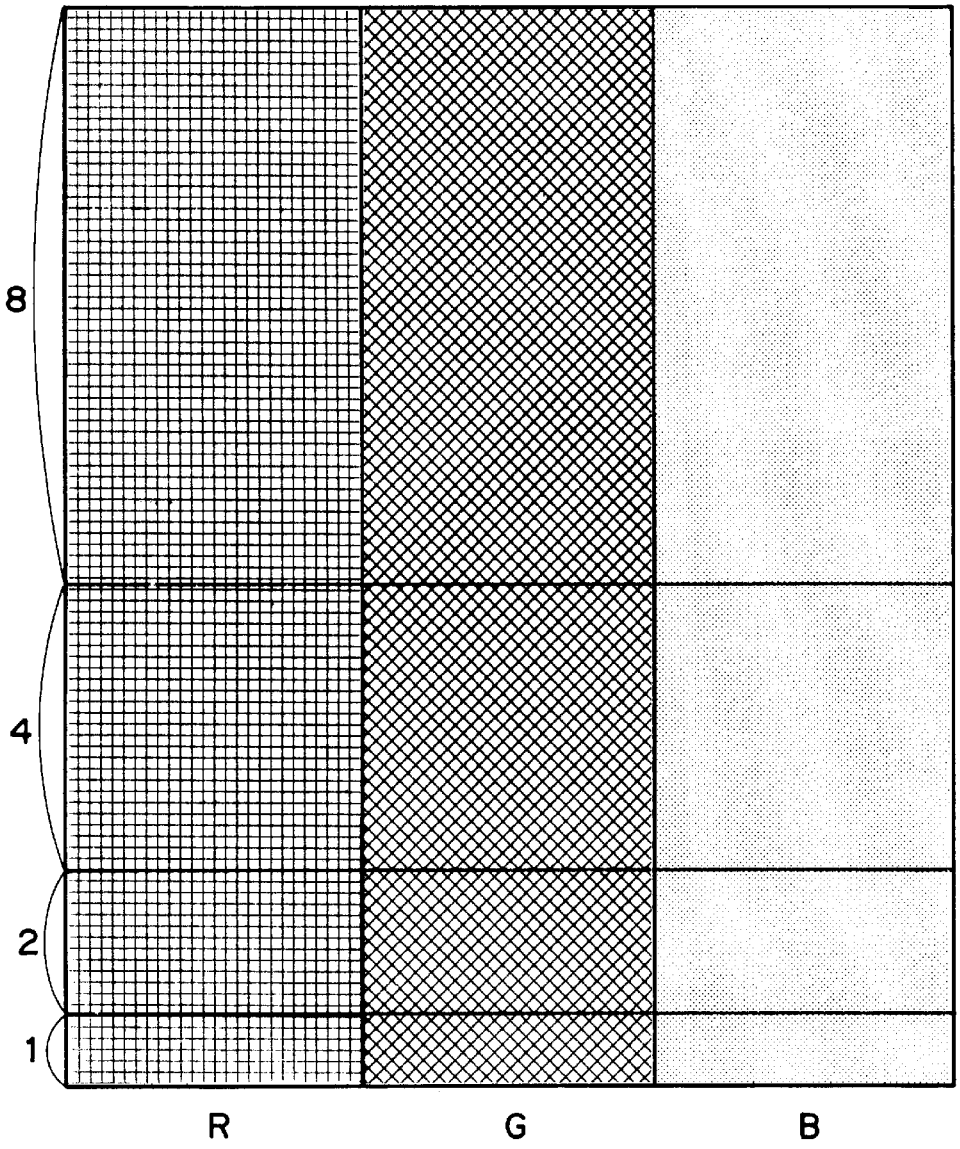
FIG. 1 is a schematic view of an example of a pixel divided into a plurality of sub-pixels so as to allow a multi-level gradational display.
Figure 2:
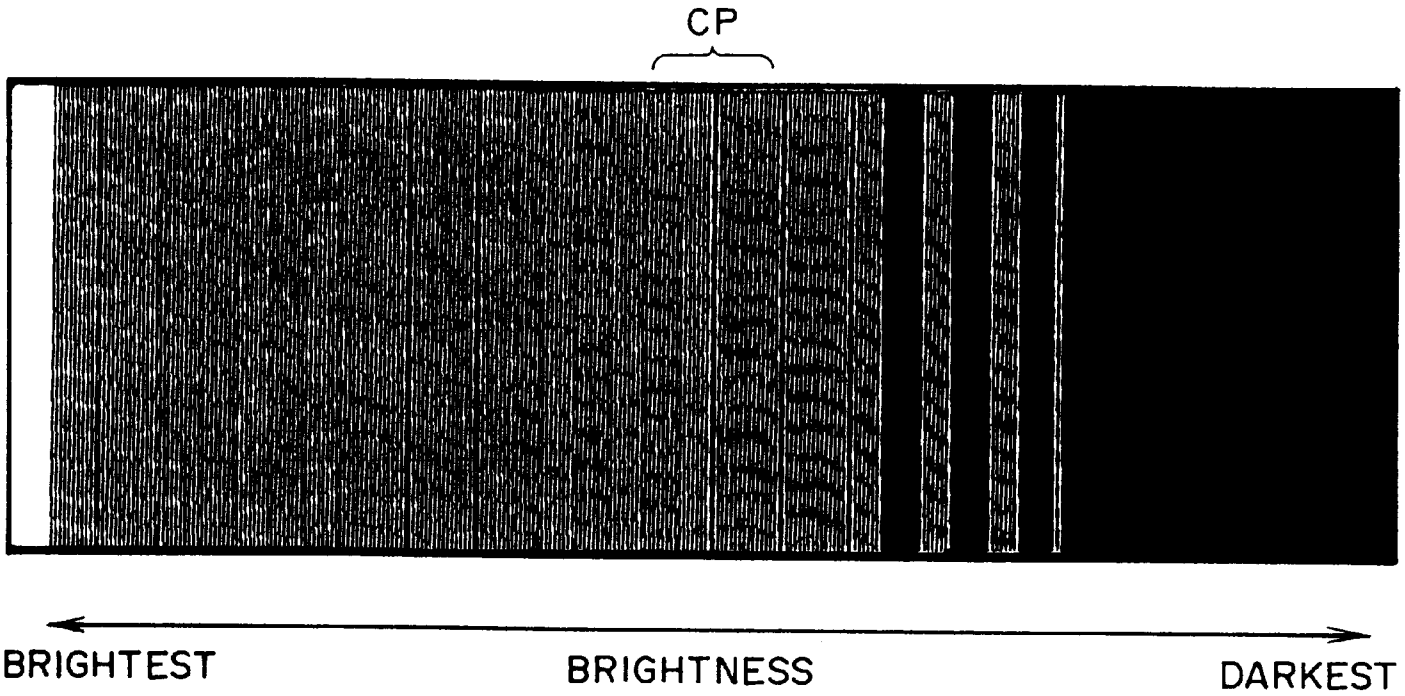
FIG. 2 is a schematic view of gradation bars displaying a brightness which continuously changes from the darkest level (black) to the brightest level (white).
Figure 3:
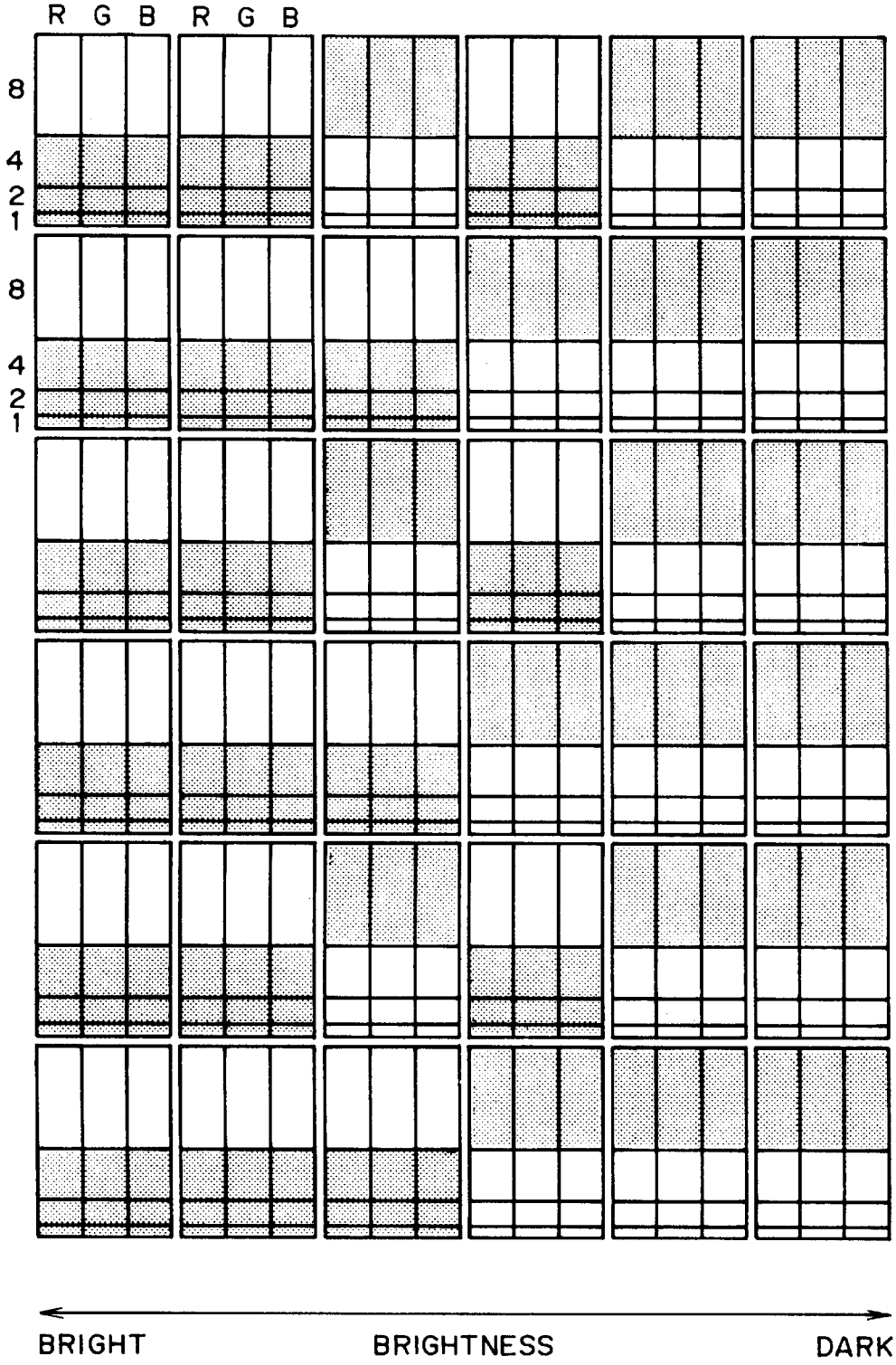
FIG. 3 is an enlarged view of a region of a gradation bar central part where gradation levels 7 and 8 are present in mixture, displayed according to a prior art display apparatus.

Before describing preferred embodiments of the present invention, the occurrence of a characteristic but possibly defective patterns in gradational display is explained. FIG. 2 shows an example of a gradational bar displaying a brightness continuously varying from the darkest level (black) to the brightest level (white). Image processing for binarizing halftone image data according to the dither method is applied to data of gradation bars. When this gradation bar display technique is applied to a display device having a pixel arrangement as shown in FIG. 1, a characteristic pattern can be recognized in the neighborhood of a central part (CP). According to our experiment including an observation of an enlarged state, it has been found that the part of the characteristic pattern corresponds to a part where gradation levels 7 and 8 are co-present to give a gradation level 7.5 as shown in FIG. 3 (enlarged view). The reason why the pattern is clearly recognized is that (1) the gravity center of light spots (i.e., gravity center of sub-pixels placed in the bright state) is remarkably changed, and (2) a periodical pattern of light spots (i.e., sub-pixels placed in the bright state) is clearly changed, respectively when a pixel is shifted to a next gradation level. In case of pixel division as shown in FIG. 1, the gravity center of light spots can be shifted by a half pitch or more. As a result, a large difference in pattern between adjacent pixels can be visually recognized.

Further, a similar experiment was also performed with respect to a display device having a pixel division pattern comprising vertical and horizontal boundaries shown in FIG. 1 (hereinafter called "division pattern B"), a similar pattern was observed at a similar part, i.e., a part where gradation levels 7 and 8 were present in mixture to provide a gradation level of 7.5.

According to such pixel division schemes, an inferior image quality results because a linear defect is clearly recognized at a position where such a pattern is not included in a desired image to be displayed.

In order to obviate such a shift (deviation) of the gravity center of light spots, the above-mentioned Japanese Laid-Open Utility Model Application 61-42591 and U.S. Pat. No. 5,124,695 teach to further divide a sub-pixel into concentric circles. However, according to such a scheme, an electrode pattern for providing pixels becomes complicated, and an aperture rate (percentage of effective pixel region area) is decreased as the number of divisions is increased, so that it is difficult to provide a high-performance display at a low cost.

In contrast thereto, according to the display apparatus of the present invention, it is possible to suppress the shift of the gravity center of light spots without resorting to such a scheme.

According to some embodiments of the present invention, sub-pixels in a unit pixel may for example have areal ratios of 1:2:3, 2:3:4, 3:4:5, 4:5:6, . . . 1:2:3:6, 1:2:4:7, 1:2:3:5, 1:2:3:4, 1:2:4:5, 1:2:4:6, . . . 2:3:4:5, 2:3:4:6 . . . .

It is further preferred to use a division pattern of, e.g., 1:2:3:4 including a ratio of 1:2 for the smallest sub-pixel and the second smallest sub-pixel, rather than a division pattern of, e.g., 2:3:4:5.

It is further preferred to adopt a division into 4 sub-pixels having areal ratios of, e.g., 1:2:3:5 rather than into 3 sub-pixels having areal ratios of, e.g., 1:2:3. This is because, in the former case of 4 sub-pixels, it is possible to select a display pattern for displaying a 5-th halftone level of 5/11 according to an areal ratio either turning on only the largest sub-pixel having an areal ratio of 5/11 or turning on two sub-pixels having the second and third sub-pixel having areal ratios of 2/11 and 3/11. In this way, it is preferred to design a division pattern so that at least one halftone level can be displayed by selecting one from at least two display patterns.

A color display may be constituted by dividing one pixel into respective color pixels as unit pixels, each of which may be further divided into at least three sub-pixels.

The color pixel combination may for example be: red (R), green (G), blue (B) and white (W); yellow (Y), cyan (Cy) and magenta (M); etc.

In a preferred embodiment of the present invention, image processing as represented by the dither method or the density pattern method may be effected so that image data having a larger number of gradation levels than that expected by the division into sub-pixels.

Figure 5:
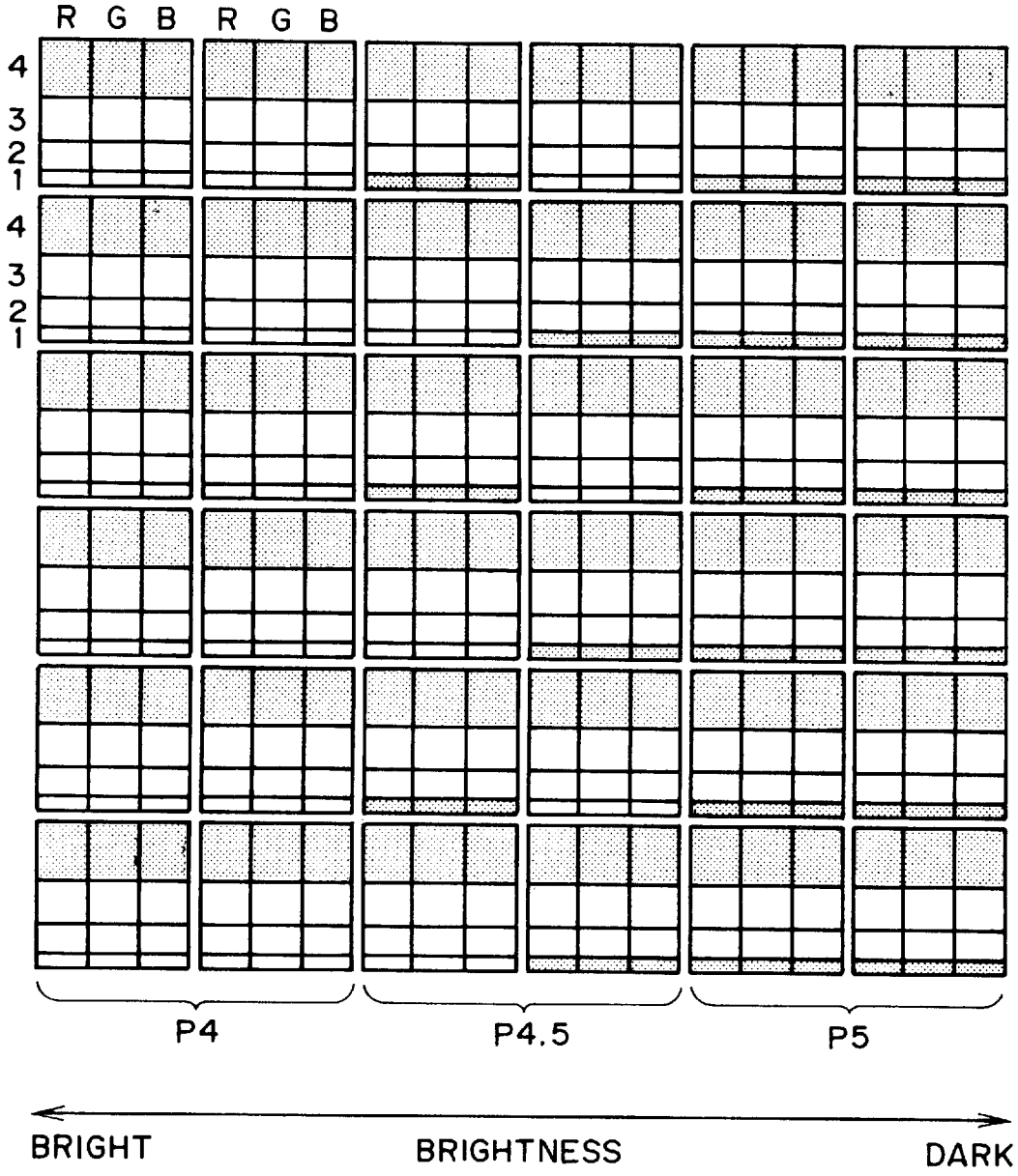
FIG. 5 is an enlarged view of a region of a gradation bar central part where gradation levels 4 and 5 are present in mixture, displayed according to an embodiment of the display apparatus according to the invention.

FIG. 5 is an enlarged view of a display region when image display is effected according to image processing by the dither method by using an embodiment of the display apparatus according to the present invention. More specifically, FIG. 5 is an enlarged view of a display region at a central part of gradation bars where halftone levels 4 and 5 are present in mixture. It is seen that the shift of image light spots and the difference in image pattern between adjacent pixels are smaller than those in the display scheme show in FIG. 3. As a result, the occurrence of a linear defect is alleviated.

More specifically, in the embodiment shown in FIG. 5, 2×2 (=4) unit pixels are used for image processing to display halftone levels. A halftone level 4 is displayed at P4, a halftone level 5 is displayed at P5, and a halftone level 4.5 is displayed at P4.5. FIG. 5 shows that the shift among such three levels can be performed with an alleviated shift (deviation) of light spots compared with the display scheme shown in FIG. 3.

In this way, according to a preferred embodiment of the display apparatus of the present invention, image processing can be effected so as to select bright and dark sub-pixels from a plurality of unit pixels, thereby displaying a number of gradation levels which is larger than that which can be displayed by using a single unit pixel.

Figure 6:
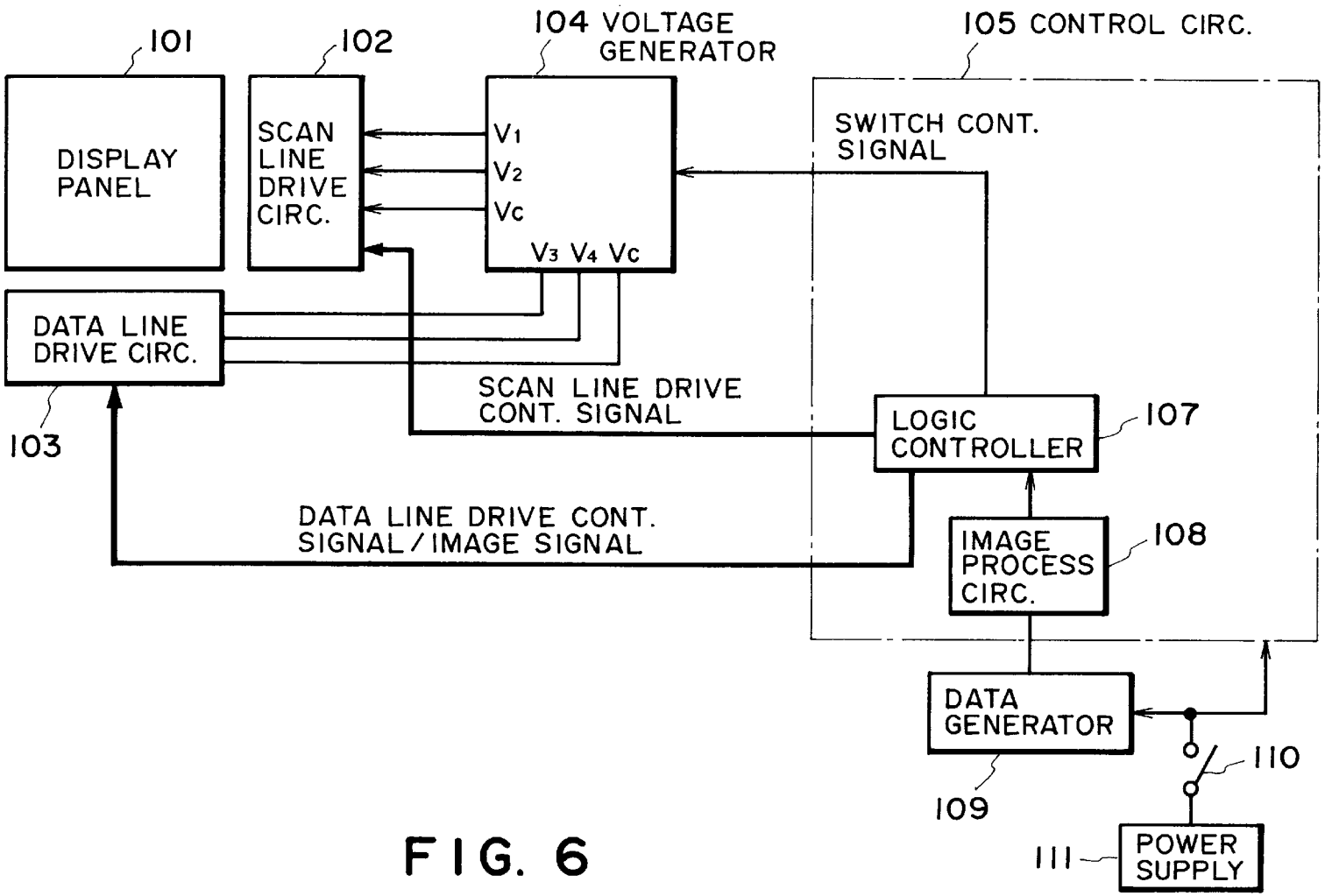
FIG. 6 is a block diagram of an embodiment of the display apparatus according to the invention.

FIG. 6 is a block diagram of an embodiment of the display apparatus according to the present invention including such an image-processing circuit.

Referring to FIG. 6, the display apparatus includes a display panel 101 using, e.g., a liquid crystal and comprising a plurality of unit pixels each in turn comprising a plurality of sub-pixels which is capable of binary display. The display panel 101 includes scanning lines to which a scanning signal is sequentially supplied from a scanning line drive circuit 102, and data lines to which data signals are supplied from a data line drive circuit 103 in synchronism with the scanning signal. Thus, the display panel is subjected to a multiplexing drive.

For the drive, reference voltages $V_1$, $V_2$, $V_3$, $V_4$ and Vc are supplied to the circuits 102 and 103 from a drive voltage generating circuit 104.

These circuits 102, 103 and 104 are controlled by respective control signals supplied from a control circuit 105 including a logic control circuit 107 and an image processing circuit, where the image processing is performed, e.g., according to the dither method. More specifically, the image processing is performed based on gradational image data supplied from a data generating section 109 so as to determine how the sub-pixel of the display panel 101 are turned on. The display apparatus is driven by electricity supplied from a power supply 111 through a power switch 110.

Next, some details of such an image-processing circuit 108 will be described with reference to image processing according to the error-diffusion method as a dither method.

Figure 7:
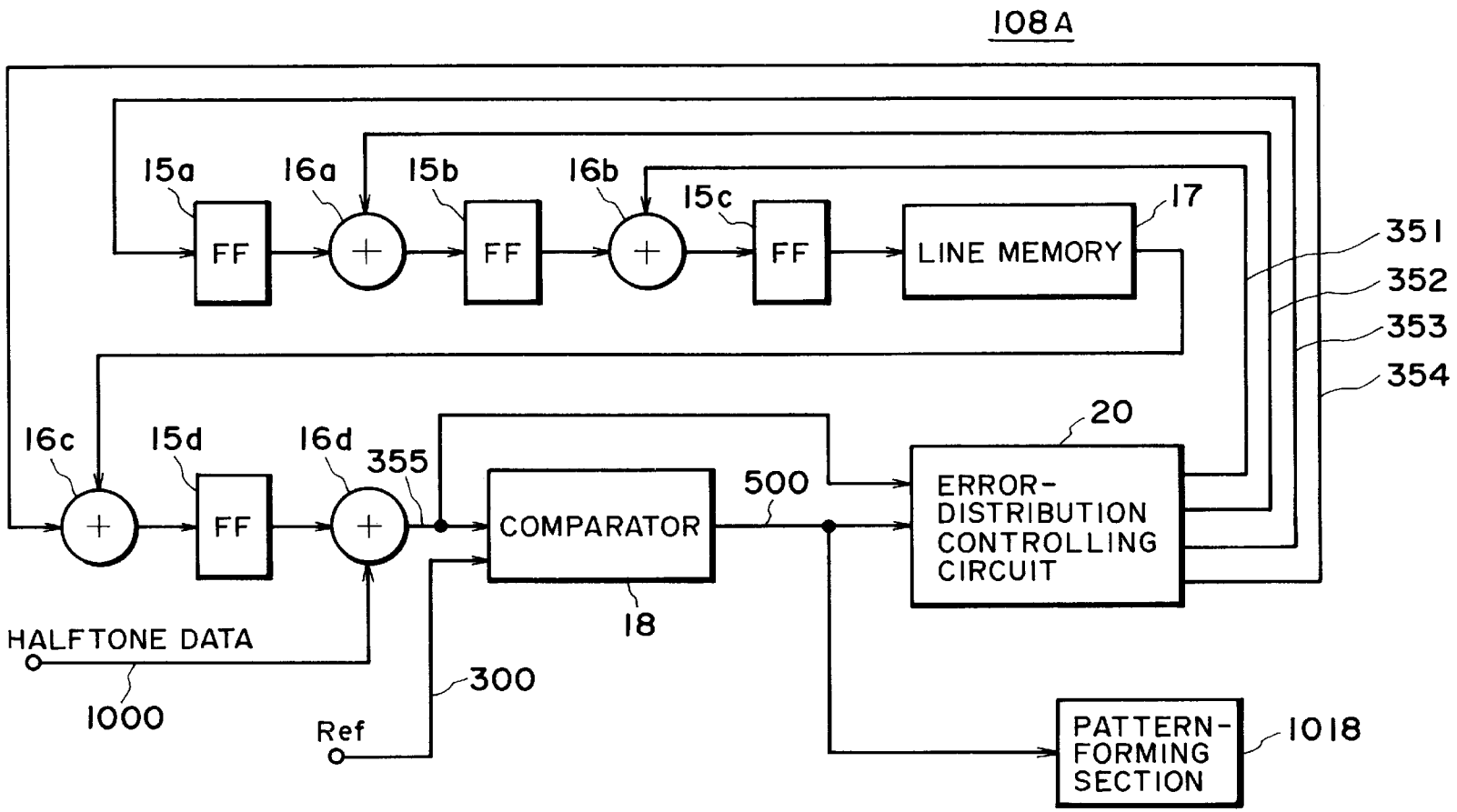
FIG. 7 is a block diagram of an example of an image processing circuit used in the invention.

FIG. 7 shows the details of such an image processing circuit 108A (binarizing circuit) according to this embodiment. The organization and operation of the circuit are described below.

The image processing circuit 108A shown in FIG. 7 includes flip-flops (hereinafter abbreviated as "FF(s)") 15*a* to 15*d* for latching data, adders 16*a* to 16*d*, a line memory 17 for introducing a time delay for one line, a comparator 18, an AND gate 19, and an error-distribution controlling circuit 20.

First of all, corrected data (original image data corresponding to the position of an objective pixel (i, j)) is inputted to the adder 16*d* through a data line 1000. In the adder 16*d*, the corrected data is added to an error (stored in FF15) which is to be distributed to the pixel position (i, j). The total value is outputted through a line 355 to the comparator 18 and the error-distribution controlling circuit

20. The comparator 18 compares the data on the line 355 with threshold data (supplied through a line 300) to output a binarized signal of "1" or "0" to a signal line 500 when the data on the line 355 is large or smaller than the threshold data, respectively.

The error-distribution controlling circuit 20 calculates a difference (error) between the signal on the line 355 before binarization and a value obtained by multiplying the binarized value on the line 500 by 255 (i.e., "0" or "255") and controls outputting of error amount signals 351 to 354 to be distributed to the neighboring pixels. Regarding the objective pixel (i, j), the error signals 351 to 354 are added to error values already distributed to the neighboring pixels (i−1, J+1), (i, J+1), (i+1, j+1) and (i+1, j) by the adders 16*a*, 16*b*, 16*c* and 16*d*, respectively.

Adjacent the image processing apparatus 108, a pattern-forming section 1018 such as a video RAM, including at least memory cells corresponding one-to-one to sub-pixels of the display panel. Each memory cell stores a binary data "1" or "0" based on image data binarized by the error diffusion method. Accordingly, by selecting the display state of each sub-pixel based on binary data stored in the pattern-forming section, a halftone display processed by the error diffusion method can be displayed on the display panel.

As a specific experimental example, a large number of display panels each comprising a chiral smectic liquid crystal disposed between a pair of substrates were prepared. Each panel was provided with a large number of unit pixels each comprising a plurality of sub-pixels having areal ratios described hereinafter by appropriately designing the shapes of the intersection of scanning electrodes and data electrodes and the shapes of color filter segments.

EXAMPLES 1–6 AND COMPARATIVE EXAMPLES 1 AND 2

More specifically, liquid crystal display panels using a chiral smectic liquid crystal capable of binary display were prepared to have a plurality of pixels (pixel pitch=200 $\mu$m×200 $\mu$m) each having three color pixels of R, G and B (unit pixels) and each divided into four sub-pixels having areal ratios shown in Table 1 below according to division pattern A shown in FIG. 1. The respective liquid crystal display panels were driven to display a photographic image including a woman's face and gradation bars as described before while effecting image processing according to the dither method so as to provide an apparently increased number of gradation levels.

The displayed images were evaluated by a panel including 10 panelists with respect to linear defect and overall image quality. Each panelist judged the evaluation result by three levels of "good", "fair" and "poor". The results are inclusively indicated by three levels of ○, Δ and x according to the standards that x indicates that 4 or more panelists judged poor, ○ indicates that 2 or less panelists judged poor, and Δ indicates the remainder. The results are shown in the following Table 1.

TABLE 1

| | Areal ratios of sub-pixels | Number of gradation levels | Image quality |
|---|---|---|---|
| Comp. Example 1 | 1:2:4:8 | 16 | x |
| Comp. Example 2 | 1:2:3:7 | 14 | x |
| Example 1 | 1:2:3:6 | 13 | Δ |
| Example 2 | 1:2:3:7 | 15 | Δ |
| Example 3 | 1:2:3:5 | 12 | ○ |
| Example 4 | 1:2:3:4 | 11 | ○ |
| Example 5 | 1:2:4:5 | 13 | ○ |
| Example 6 | 1:2:4:6 | 14 | ○ |

The above results show that good results were attained when the largest sub-pixel had an area which did not exceed the total area of the remaining sub-pixels, particularly when the largest sub-pixel had an area which was smaller than the total area of the remaining sub-pixels.

EXAMPLE 7

Figure 4:
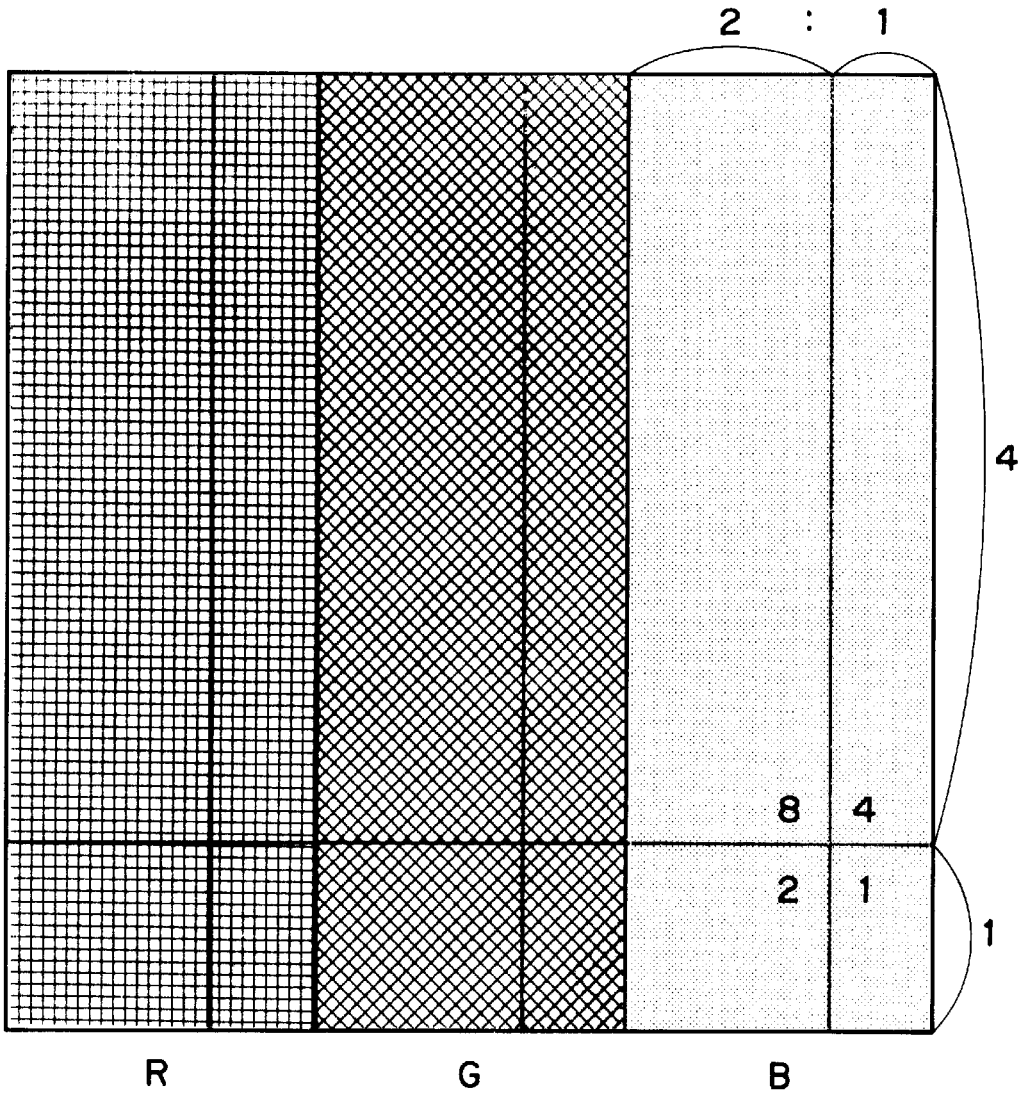
FIG. 4 is a schematic view of another example of a pixel divided into a plurality of sub-pixels for a multi-level gradational display.

Two types of liquid crystal display panels were prepared in a similar manner as in the above Examples but by adopting division pattern B shown in FIG. 4 into 4 sub-pixels having areal ratios shown in Table 2 below. In Example 7, a unit pixel was divided into four sub-pixels having areal ratios of 1:2:3:6 by a vertical division ratio of 1:3 and a horizontal division ratio of 1:2. The results are shown in Table 2 below.

TABLE 2

| | Areal ratios of sub-pixels | Number of gradation levels | Image quality |
|---|---|---|---|
| Comp. Example 3 | 1:2:4:8 | 16 | x |
| Example 7 | 1:2:3:6 | 13 | Δ |

Similarly as in Examples 1–6 and Comparative Examples 1 and 2 described above, good results were attained in Example 7 where the largest sub-pixel had an area which did not exceed the total area of the remaining sub-pixels,

EXAMPLES 8 AND 9

Two types of liquid crystal panels were prepared similarly as in Examples 1–6 by adopting division pattern A into four sub-pixels having areal ratios shown in Table 3.

TABLE 3

| | Areal ratios of sub-pixels | Number of gradation levels |
|---|---|---|
| Example 8 | 2:3:4:5 | 15 |
| Example 9 | 1:2:3:4 | 11 |

All the panelists agreed that the liquid crystal panel of Example 9 provided a better image quality. This may be attributable to a fact that the panel of Example 8 lacked in continuity of halftone levels, e.g., inability of displaying levels 1/14 and 13/14.

As described above, according to the display apparatus of the present invention, it is possible to suppress the shift of gravity center of light spots and the change of pixel pattern at the time of changing gradational display levels so that a linear defect attributable to a pixel division pattern can be obviated or suppressed by a simple re-arrangement of sub-pixels to realize a smooth continuous gradational display.

What is claimed is:

1. A display apparatus comprising:

display means including a display panel having a plurality of unit pixels each divided into at least three sub-pixels for displaying a halftone, said at least three sub-pixels having mutually different areas, wherein one sub-pixel with the largest area among said at least three sub-pixels has a maximum area which does not exceed a total area of the remaining sub-pixels among said at least three sub-pixels; and an image processing circuit for displaying a number of halftone levels on said display panel by said plurality of unit pixels, with the number being larger than a number of halftone levels that can be displayed by a single unit pixel, wherein each said unit pixel is divided into three longitudinally elongated color pixels which are disposed laterally adjacently, and each color pixel is divided only in a longitudinal direction into said at least three sub-pixels having areal ratios such that at least one halftone level can be displayed by selecting one from at least two display patterns each formed by a combination of on-state and off-state of the sub-pixels.

2. An apparatus according to claim 1, including a plurality of pixels each divided into a plurality of color pixels for color display comprising said unit pixels, each of which is divided into said at least three sub-pixels.

3. An apparatus according to claim 1, wherein the maximum area of the one sub-pixel is smaller than the total area of the remaining sub-pixels.

4. A display apparatus according to claim 1, wherein said unit pixel is divided into three sub-pixels having an areal ratio of 1:2:3.

5. A display apparatus according to claim 1, wherein one unit pixel is divided into four sub-pixels having areal ratios selected from 1:2:3:6, 1:2:4:7, 1:2:3:5, 1:2:3:4, 1:2:4:5, 1:2:4:6, 2:3:4:5 or 2:3:4:6.

6. A display apparatus according to claim 1, wherein said at least three pixels include a smallest sub-pixel and a second smallest sub-pixel having an areal ratio of 1:2.

7. A display apparatus comprising:

display means including a display panel having a plurality of unit pixels each divided into at least three sub-pixels for displaying a halftone, said at least three sub-pixels having mutually different areas, wherein one sub-pixel with the largest area among said at least three sub-pixels has a maximum area which does not exceed a total area of the remaining sub-pixels among said at least three sub-pixels; and an image processing circuit for converting data into binary data according to a dither method, wherein each said unit pixel is divided into three longitudinally elongated color pixels which are disposed laterally adjacently, and each color pixel is divided only in a longitudinal direction into said at least three sub-pixels having areal ratios such that at least one halftone level can be displayed by selecting one from at least two display patterns each formed by a combination of on-state and off-state of said sub-pixels.

8. An apparatus according to claim 7, including a plurality of pixels each divided into a plurality of color pixels for color display comprising said unit pixels, each of which is divided into said at least three sub-pixels.

9. An apparatus according to claim 7, wherein the maximum area of the one sub-pixel is smaller than the total area of the remaining sub-pixels.

10. A display apparatus according to claim 7, wherein said unit pixel is divided into three sub-pixels having an areal ratio of 1:2:3.

11. A display apparatus according to claim 7, wherein one unit pixel is divided into four sub-pixels having areal ratios selected from 1:2:3:6, 1:2:4:7, 1:2:3:5, 1:2:3:4, 1:2:4:5, 1:2:4:6, 2:3:4:5 or 2:3:4:6.

12. A display apparatus according to claim 7, wherein said at least three pixels include a smallest sub-pixel and a second smallest sub-pixel having an areal ratio of 1:2.

13. A display apparatus comprising:

display means including a display panel having a plurality of unit pixels each divided into at least three sub-pixels for displaying a halftone, said at least three sub-pixels having mutually different areas, wherein one sub-pixel with the largest area among said at least three sub-pixels has a maximum area which does not exceed a total area of the remaining sub-pixels among said at least three sub-pixels; and an image processing circuit for converting data into binary data by an error-diffusion method, wherein each said unit pixel is divided into three longitudinally elongated color pixels which are disposed laterally adjacently, and each color pixel is divided only in a longitudinal direction into said at least three sub-pixels having areal ratios such that at least one halftone level can be displayed by selecting one from at least two display patterns each formed by a combination of on-state and off-state of the sub-pixels.

14. An apparatus according to claim 13, including a plurality of pixels each divided into a plurality of color pixels for color display comprising said unit pixels, each of which is divided into said at least three sub-pixels.

15. An apparatus according to claim 13, wherein the maximum area of the one sub-pixel is smaller than the total area of the remaining sub-pixels.

16. A display apparatus according to claim 13, wherein said unit pixel is divided into three sub-pixels having an areal ratio of 1:2:3.

17. A display apparatus according to claim 13, wherein one unit pixel is divided into four sub-pixels having areal ratios selected from 1:2:3:6, 1:2:4:7, 1:2:3:5, 1:2:3:4, 1:2:4:5, 1:2:4:6, 2:3:4:5 or 2:3:4:6.

18. A display apparatus according to claim 13, wherein said at least three pixels include a smallest sub-pixel and a second smallest sub-pixel having an areal ratio of 1:2.

19. A display apparatus comprising:

display means including a display panel having a plurality of unit pixels each divided into at least three sub-pixels for displaying a halftone, said at least three sub-pixels having mutually different areas, wherein one sub-pixel with the largest area among said at least three sub-pixels has a maximum area which does not exceed a total area of the remaining sub-pixels among said at least three sub-pixels; and an image processing circuit for converting data into binary data by a density pattern method, wherein each said unit pixel is divided into three longitudinally elongated color pixels which are disposed laterally adjacently, and each color pixel is divided only in a longitudinal direction into said at least three sub-pixels having areal ratios such that at least one halftone level can be displayed by selecting one from at least two display patterns each formed by a combination of on-state and off-state of the sub-pixels.

20. An apparatus according to claim 19, including a plurality of pixels each divided into a plurality of color pixels for color display comprising said unit pixels, each of which is divided into said at least three sub-pixels.

21. An apparatus according to claim 19, wherein the maximum area of the one sub-pixel is smaller than the total area of the remaining sub-pixels.

22. A display apparatus according to claim 19, wherein said unit pixel is divided into three sub-pixels having an areal ratio of 1:2:3.

23. A display apparatus according to claim 19, wherein one unit pixel is divided into four sub-pixels having areal ratios selected from 1:2:3:6, 1:2:4:7, 1:2:3:5, 1:2:3:4, 1:2:4:5, 1:2:4:6, 2:3:4:5 or 2:3:4:6.

24. A display apparatus according to claim 19, wherein said at least three pixels include a smallest sub-pixel and a second smallest sub-pixel having an areal ratio of 1:2.

25. A display apparatus, comprising:

display means including a display panel having a plurality of pixels each divided into a plurality of color pixels for color display, including color pixels of at least one color each divided into at least three sub-pixels, said at least three sub-pixels having mutually different areas, wherein one sub-pixel with the largest area among said at least three sub-pixels has a maximum area which is smaller than a total area of the remaining sub-pixels; and an image processing circuit for displaying a number of halftone levels by plural color pixels, the number being larger than a number of halftone levels that can be displayed by a single color pixel, wherein each said unit pixel is divided into three longitudinally elongated color pixels which are disposed laterally adjacently, and each color pixel is divided only in a longitudinal direction into said at least three sub-pixels having areal ratios such that at least one halftone level can be displayed by selecting one from at least two display patterns each formed by a combination of on-state and off-state of the sub-pixels.

26. An apparatus according to claim 25, further including an image processing circuit for converting data into binary data according to a dither method.

27. An apparatus according to claim 25, further including an image processing circuit for converting data into binary data by an error-diffusion method.

28. An apparatus according to claim 25, further including an image processing circuit for converting data into binary data by a density pattern method.

* * * * *

UNITED STATES PATENT AND TRADEMARK OFFICE

CERTIFICATE OF CORRECTION

PATENT NO. : 6,714,212 B1 
DATED : March 30, 2004
INVENTOR(S) : Akira Tsuboyama et al.

It is certified that error appears in the above-identified patent and that said Letters Patent is hereby corrected as shown below:

Title page,
Item [56], References Cited, FOREIGN PATENT DOCUMENTS,
"5546783 should read -- 55-46783
6142591 61-42591
1267519" 1-267519 --.

Column 1,
Line 14, "electrochromic" should read -- or electrochromic --.

Column 2,
Line 3, "sub-pixels" should read -- sub-pixel --.
Line 4, "sub-pixel" should read -- sub-pixels --.

Column 4,
Line 44, "sub-pixel" should read -- sub-pixels --.

Column 5,
Line 16, "108, a" should read -- 108, is a --.

Column 6,
Line 43, "sub-pixels," should read -- sub-pixels. --.

Signed and Sealed this

Fourth Day of April, 2006

JON W. DUDAS
*Director of the United States Patent and Trademark Office*